United States Patent [19]

Zelenov et al.

[11] 4,316,542

[45] Feb. 23, 1982

[54] ELECTROMAGNETIC SEPARATOR

[76] Inventors: Petr I. Zelenov, Leningradsky prospekt, 7, kv. 253, Olenegorsk Murmanskoi oblasti; Petr A. Usachev, ulitsa Fersmana, 20, kv. 54; Jury V. Davydov, ulitsa Zinovieva, 8, kv. 13, both of Apatity Murmanskoi oblasti; Vyacheslav P. Lyakhov, 3 mikroraion, 2, kv. 56; Irina M. Zelenova, Leningradsky prospekt, 7, kv. 253, both of Olenegorsk Murmanskoi oblasti; Nikolai A. Aleinikov, ulitsa Fersmana, 16, kv. 21, Apatity Murmanskoi oblasti; Vladlen F. Sladkovich, ulitsa Komsomola, 6, kv. 4; Viktor I. Titov, ulitsa Mira, 8, kv. 9, both of Olenegorsk Murmanskoi oblasti, all of U.S.S.R.

[21] Appl. No.: 169,214

[22] Filed: Jul. 15, 1980

[51] Int. Cl.[3] ..... B03C 1/30

[52] U.S. Cl. ..... 209/39; 209/224

[58] Field of Search ..... 209/224, 225, 223 R, 209/232, 39; 210/222, 223, 214, 213

[56] References Cited

U.S. PATENT DOCUMENTS

| | | | |
|---|---|---|---|
| 954,015 | 4/1910 | Bent | 209/232 |
| 1,392,413 | 10/1921 | Gow | 209/224 X |
| 1,605,117 | 11/1976 | Kolzumi | 209/223 R |
| 3,351,195 | 11/1967 | Hukki | 209/39 |
| 3,905,894 | 9/1975 | Hukki | 209/158 X |

FOREIGN PATENT DOCUMENTS

| | | | |
|---|---|---|---|
| 234200 | 1/1969 | U.S.S.R. | 209/39 |
| 559729 | 1/1975 | U.S.S.R. | 209/39 |
| 543414 | 1/1977 | U.S.S.R. . | |

*Primary Examiner*—Robert Halper

*Attorney, Agent, or Firm*—McAulay, Fields, Fisher, Goldstein & Nissen

[57] ABSTRACT

The electromagnetic separator comprises a cylindrical housing with a conical bottom, a circular electromagnetic system embracing the separator housing on the outside, a cylindrical pulp feeding device with a paddle agitator, a system of disks, a wash water feeding device, a nonmagnetic product discharging device and a magnetic product discharge branch.

In order to increase the efficiency of separator operation by providing the appropriate hydrodynamic conditions of pulp flow, the separator comprises a system of disks with holes. The disks are spaced apart and installed one under the other directly underneath the pulp feeding device. The bottom disk is provided with a wash water feeding device constructed in the form of a circular element with tangential branches, there being a gap around the outer side of said circular element.

The paddle agitator is located inside the bottom part of the pulp feeding device whose top part is provided with tangential branches.

The system of disks, the wash water feeding device and the paddle agitator are located inside the part of the housing which is embraced by the circular electromagnetic system.

8 Claims, 1 Drawing Figure

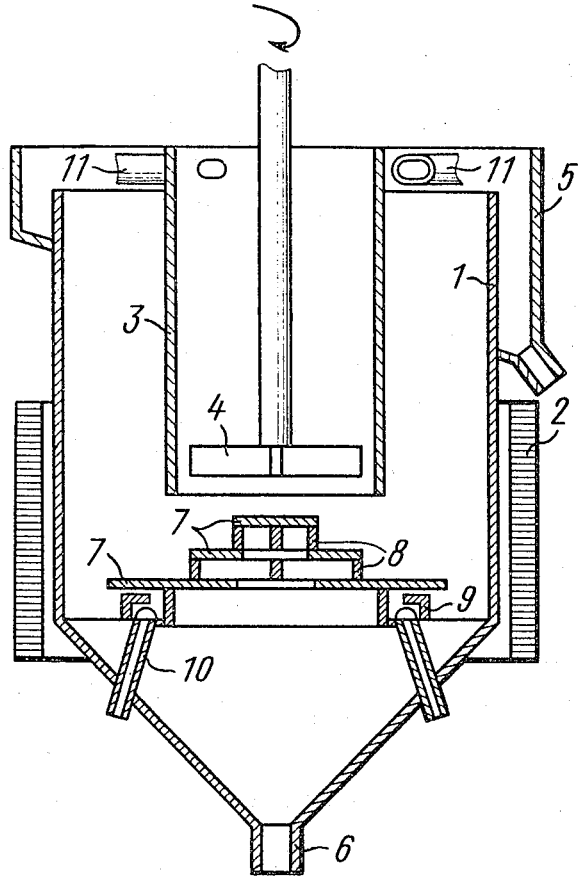
11
11
5
1
3
4
2
7
7
8
9
10
6

ELECTROMAGNETIC SEPARATOR

FIELD OF THE INVENTION

The invention relates to concentration of minerals and has particular reference to electromagnetic separators designed for separating grainy minerals by the agency of their magnetic properties in processes of primary ore treatment.

The present invention can be used for concentration of finely disseminated magnetites and final treatment of magnetite concentrates as well as for obtaining highly clean iron concentrates and for desliming and thickening pulp containing grains of magnetic minerals.

The electromagnetic separator of the present invention can be used with particular advantage for obtaining highly clean iron concentrates, especially from finely disintegrated and slimy mineral ores.

BACKGROUND OF THE INVENTION

In the primary treatment of iron ore, it is well known to use magnetic separators with permanent magnets or electromagnetic systems for wet separation of grainy materials by the agency of their magnetic properties. Depending on the properties of the minerals under treatment and the process employed for separating grains of magnetic minerals, use is made of magnetic separators of various designs, said separators operating with appropriate values of magnetic forces acting on grains of magnetic minerals.

Most widely known in the art of ore concentration are drum-type magnetic separators with a magnetic field intensity of 60 to 160 kA/m (kiloamperes per meter).

A drum-type magnetic separator comprises a trough with a pulp feeding device and devices for discharging magnetic and nonmagnetic products, and a cylindrical drum made of a nonmagnetic material and mounted horizontally for rotation about the axis thereof. Said drum is partially situated in the trough and accommodates an magnetic system which is located inside the drum nearer the trough.

The pulp containing grains of magnetic and nonmagnetic minerals is delivered into the separator trough through the feeding device. As the pulp flows in the separator trough, the forces of the magnetic field created by the magnetic system attract grains of magnetic materials to the surface of the nonmagnetic drum located underneath the magnetic system. As the drum rotates, the magnetic mineral grains attracted by the magnetic field forces travel together with the drum toward the device for discharging the magnetic product, whereas the nonmagnetic material grains are carried by the pulp flow to the device for discharging the nonmagnetic product.

In such separators, the magnetic attraction forces should considerably exceed the dynamic forces of the pulp flow and the force of gravity of magnetic mineral grains. To this end, use is made of magnetic systems which create highly nonuniform magnetic fields of as high intensity as 60 to 160 kA/m in order to separate magnetic mineral grains from the pulp flow and retain them on the drum surface.

In said separators, because of strong magnetic interaction of magnetic mineral grains therebetween and with the magnetic field created by the magnetic system, lingering accumulations of magnetic mineral grains are formed on the drum surface, said accumulations entraining nonmagnetic mineral grains and concretions thereof with magnetic minerals.

Removal of entrained nonmagnetic mineral grains and their concretions from lingering accumulations of magnetic mineral grains is difficult and can be accomplished only by repeatedly cleaning the magnetic product, the effectiveness of operation of drum-type magnetic separators ever decreasing toward the final stages of treatment. Therefore, in spite of perfection of design, the drum-type magnetic separators under discussion do not provide for high selectivity of separating grainy materials by the agency of their magnetic properties, particularly in the processes of final treatment and recovery of pure iron concentrates from finely disintegrated and slimy ores.

Known in the art are magnetic separators designed for selective separation of magnetic mineral grains. Said separators depend for their operation on varying local concentration of magnetic mineral grains in flowing pulp under the action of a slightly nonuniform magnetic field of as low intensity as 2 to 10 kA/m.

With low intensity magnetic fields, the appropriate relationship of magnetic and dynamic forces produces a concentrated bed of movable magnetic mineral grains in the lower part of the pulp flow. Nonmagnetic mineral grains are readily washed out from said bed by water flows and, therefore, in this case the magnetic product can be recovered from the pulp without separating it by attraction to some surface by the agency of a strong magnetic field.

In low intensity electromagnetic separators use is made of electromagnetic systems whose attraction force is sufficient to change the line of travel of magnetic mineral grains, but is usually less than the force of gravity of the same.

Known in the art is an electromagnetic separator operating on the principle described above. This separator comprises a nonmagnetic housing made in the form of a vertical cylinder open on the top, a circular electromagnetic system located outside the housing at the bottom part thereof, a pulp feeding device with tangential branches located at the level of the electromagnetic system, a nonmagnetic product discharging device located in the top part of the housing, and magnetic product discharge branches located in the bottom part of the separator housing.

The pulp is delivered under pressure into the separator housing through the feeding device with the tangential branches so that the feed is given a circular rotary motion. When the magnetic field created by the electromagnetic system is applied to the pulp flow in the housing, it changes the line of travel of magnetic mineral grains so that instead of moving helically from bottom to top together with the main flow of the pulp they form a concentrated bed in the bottom part of the housing. As said bed is formed, grains of nonmagnetic minerals are washed out therefrom by upward flows of the pulp and carried into the nonmagnetic product discharging device. The grains of magnetic minerals accumulate in the bottom part of the separator housing and are discharged from the separator via the magnetic product discharge branch.

In the electromagnetic separator under discussion, the pulp feeding device, which is provided with tangential branches, does not cater for the required velocity of pulp rotary motion even at the maximum rate of pulp feed. This disadvantage results in failure to provide the relationship between the magnetic and dynamic forces appropriate to the magnetic field intensity required for the grains of magnetic minerals to form a bed of concentrated and yet movable material. Hence, the electromagnetic separator under discussion suffers from the disadvantage of low separation selectivity and low operating efficiency.

Also known in the art is a wet separation apparatus which consists of an open housing with a cylindrical upper part and a conical lower part.

The top or middle of the cylindrical part of the housing is in the form of a screen. Inside the housing is installed a shaft which drives disk-shaped distributing plates attached thereto. A row of vertical blades is attached to the edge of one of the distributing plates.

The distributing plates are installed one above the other so that they form an even, shallow slope. One or several plates have holes. The apparatus also comprises a pulp feeding device in the form of a circular pipe, a chute installed in the top part of the housing and designed for collecting and discharging fines, and a coarse product discharge branch located in the bottom part of the housing. A pipe with a circular channel for supplying wash water is provided in the conical bottom part of the apparatus.

The wet separation apparatus operates as follows:

The material to be separated according to size is fed in the form of pulp via the feeding device, which is constructed as a circular pipe, into the middle part of the apparatus housing where the pulp is uniformly distributed throughout the circumference with the aid of the distributing plates. The largest and, consequently, the heaviest grains form the lowermost layer. The fine material is carried by the pulp current into the top part of the apparatus where it is given a rotary motion about the vertical axis at a predetermined velocity by the rotating vertical blades attached to the edge of one of the distributing plates. This layer of the pulp moves at the appropriate angular velocity relative to the screen surface at rest and the whole mass of fine particles in the form of fluid pulp passes through the screen holes into the chute for collecting and discharging fines. The portion of the solid particles which does not pass through the screen holes settles into the bottom part of the housing where the coarse product is carried away through the discharge branch. The boundary separation size of the material under treatment can be regulated by setting the appropriate velocity of pulp rotation relative to the screen. The fine grains are removed from the bottom part of the apparatus by means of wash water supplied from the pipe which has a circular channel and is located in the conical bottom part of the housing. The wash water flows through the hole in the distributing plates and the gaps therebetween into the top part of the housing and makes for separating the coarse product from the fines.

The wet separation apparatus is designed for separating fines from a coarse material in a pulp flow, but it is not intended and cannot be used for wet separation of grainy materials according to their magnetic properties. Consequently, the efficiency of the apparatus in this type of work cannot be judged.

Yet it should be noted that the pulp flow in the middle and top parts of the housing is given high turbulence through agitation effected by the vertical blades due to which the pulp is strongly circulated in all directions and is thereby stirred both vertically and radially. Besides, the manner in which wash water is fed in the apparatus does not prevent fine mineral grains from getting through the gap between the distributing plate and the housing into the bottom part of the housing inasmuch as overpressure exists there and water delivered under pressure will not pass through said gap unless it is caused to flow in the required direction.

Known in the art is an electromagnetic separator for treating heavy ferromagnetic suspensions (U.S.S.R. Author's Certificate No. 543414, the year (1975), date of issue Mar. 15, 1977, comprising a cylindrical housing with a conical bottom, a circular electromagnetic system installed outside the housing, a cylindrical pulp feeding device installed inside the housing coaxially therewith, a paddle agitator located underneath the pulp feeding device, a light product discharging device located in the top portion of the housing, and a heavy product discharge branch located in the conical part of the separator housing. In this separator, pulp is fed through the feeding device into the housing where the paddle agitator imparts to it a circular motion at the velocity determined by the dynamic forces required for effective separation. The magnetic field created by the circular electromagnetic system changes the line of travel of the magnetic particles. By virtue of magnetic interaction at the appropriate relationship between magnetic and hydrodynamic forces a movable concentrated bed consisting mainly of magnetic mineral grains is formed in the bottom part of the separator housing. Nonmagnetic mineral grains and their concretions with magnetic minerals are easily washed out of this bed by uprising water currents of the pulp and are carried into the top part of the housing where they flow together with the pulp over the housing edge and get into the light product discharging device. The magnetic mineral grains contained in the concentrated movable bed in the bottom of the housing settle and are carried away via the heavy product discharge branch.

The separator under discussion is designed for specific gravity separation of a large-piece material in a concentrated movable bed of magnetic grains treated as a heavy suspension. Pieces of ore are delivered through the pulp feeding device into the movable concentrated bed formed in the separator. Light pieces of ore rise and are discharged by means of the light product discharging device, whereas heavy pieces of ore settle and are discharged via the heavy product discharge branch.

The separator for treating heavy ferromagnetic suspensions can also be used for separating grainy minerals by the agency of their magnetic properties. To create dynamic forces appropriate to the magnetic field, the pulp is given a rotary motion about the vertical axis by the use of the paddle agitator, whereby the proper relationship between magnetic and hydrodynamic forces required for producing a movable concentrated bed of magnetic mineral grains is readily obtained.

However, with this construction of the electromagnetic separator, the paddle agitator, which is located under the pulp feeding device, apart from imparting a major rotary motion to the pulp, also produces minor vertical pulp circulation above and below, which results in up and down stirring of grainy material. Besides, some of the pulp delivered through the feeding device flows directly into the bottom part of the housing where the magnetic product is discharged, the latter being contaminated. Furthermore, the pulp entrains air which moves in the housing upward at a high velocity, hampering the separation process.

Thus, the design of the separator under discussion fails to provide the hydrodynamic conditions of pulp flow required to prevent up and down stirring of the material and to allow removing nonmagnetic mineral grains and concretions from the magnetic product in the bottom part of the housing. This predetermines low selectivity of separation of grainy materials by the agency of their magnetic properties and, consequently, insufficient efficiency of the separator in this type of work.

Iron concentrates with low impurity content find wide and ever increasing use in various fields of the industry, for example, in nonblast-furnace production of iron, powder metallurgy, production of ferrite, making of catalysts, etc.

It is a difficult problem heretofore to obtain iron concentrates with low impurity content by means of magnetic separators since they do not provide the required high selectivity of separation of grainy minerals. Furthermore, it is very important that, apart from high selectivity, separators should have a sufficiently high ore throughput, for example 10 to 15 tons per hour.

It is known that in order to accomplish selective separation of grainy minerals the hydrodynamic conditions of pulp flow in a separator must have the following characteristics: high turbulence of the pulp in the feeding device for mineral grains to be disintegrated and partially cleaned before the pulp passes into the separator housing; a tranquil upward helical flow in the middle and top parts of the housing where separation of grainy minerals is accomplished in the main, this being aimed at avoiding vertical pulp flow circulation which causes stirring of grainy minerals in this area and hampers the separation process; partial pulp circulation and wash water counterflow against settling grains of magnetic minerals; and a pulp travel path which prevents the pulp feed flow from getting directly into the bottom part of the housing where the magnetic product is discharged.

SUMMARY

It is an object of the present invention to provide an electromagnetic separator which, by employment and arrangement of constructional elements, provides hydrodynamic conditions of pulp flow for effecting selective separation of minerals at a sufficiently high ore throughput and can be used for obtaining high quality iron concentrates.

The invention provides an electromagnetic separator comprising a cylindrical housing with a conical bottom, a circular electromagnetic system embracing the separator housing on the outside, a cylindrical pulp feeding device with a paddle agitator installed inside the separator housing coaxially therewith, a nonmagnetic product discharging device located in the top part of the separator housing, and a magnetic product discharge branch located in the bottom part of the separator housing.

According to the invention, a system of disks spaced apart and rigidly installed one under the other is located in the bottom part of the separator housing coaxially therewith, directly underneath the pulp feeding device. The second disk and all the subsequent disks have center holes whose diameters decrease from bottom to top and are smaller than the diameter of the next upper disk. The diameters of the disks increase from top to bottom. The diameters of the top and bottom disks are respectively smaller and larger than the diameter of the pulp feeding device.

The bottom disk is provided with a wash water feeding device which is located underneath the disk and coaxially therewith. Said wash water feeding device is constructed in the form of a circular element with tangential branches for feeding wash water in a predetermined direction. There is a gap all the way around the circular element at the outer side thereof facing the bottom disk and the separator housing.

The paddle agitator is installed inside the pulp feeding device, in the bottom part thereof, directly over the system of the disks and coaxially therewith. The agitator paddles are designed to rotate in the direction coinciding with the direction of wash water feed.

The separator is provided with tangential branches installed in the top part of the pulp feeding device for the purpose of feeding pulp in the direction coinciding with the direction in which wash water is fed and the agitator paddles rotate.

The system of the disks, the wash water feeding device, and the paddle agitator are located inside the separator housing, in the part thereof embraced by the circular electromagnetic system, whereby provision is made for creating the required hydrodynamic conditions of pulp flow.

BRIEF DESCRIPTION OF THE DRAWING

The invention will now be more particularly described by way of example with reference to the accompanying drawing which shows the construction of the electromagnetic separator according to the invention.

DETAILED DESCRIPTION OF THE INVENTION

The electromagnetic separator comprises a vertical cylindrical housing 1 with a conical bottom, and a circular electromagnetic system 2 embracing the separator housing 1 on the outside. A cylindrical pulp feeding device 3 accommodates a paddle agitator 4 and is installed inside the separator housing 1 coaxially therewith. A nonmagnetic product discharging device 5 is located in the top portion of the separator housing 1. A magnetic product discharge branch 6 is provided in the bottom of the separator housing 1. A system of disks 7 with their mounting elements 8 is installed in the bottom part of the separator housing 1, coaxially therewith, underneath the pulp feeding device 3. The disks 7, except the top one, have center holes and are installed one under the other so that they are spaced apart. The bottom disk 7 is provided with a wash water feeding device 9 which is secured under the disk and has tangential branches 10. Tangential branches 11 are provided in the top part of the pulp feeding device 3. All the constructional elements of the separator are made of a nonmagnetic material.

The electromagnetic separator operates as follows:

Pulp containing mineral grains is tangentially fed through the branches 11 into the top part of the cylindrical feeding device 3 where the tangential feed creates a centrifugal flow and the pulp is rapidly rid of air contained therein by the agency of the centrifugal action. Then in the bottom part of the pulp feeding device 3, where the paddle agitator 4 is installed, disintegration and partial surface cleaning of minerals are performed by virtue of high turbulence of the pulp flow which is produced near the surface of the cylindrical feed device 3 by the rotary action of the paddles of the agitator 4. Thereafter the pulp rotating about the vertical axis passes into the zone of action of the magnetic field created by the circular electromagnetic system 2, said pulp being uniformly distributed in the separator housing 1 and given a rotary motion. There, under the action of the magnetic field and forces of gravity, the grains of magnetic minerals are concentrated above the system of the disks 7 which do not allow the feed pulp to go directly into the bottom part of the separator housing 1. Said grains from a rotating layer readily movable at the predetermined relationship of magnetic and dynamic forces and this material gradually passes through the annular gap between the system of the disks 7 and the separator housing 1 into the bottom part of the housing 1. During the passage of the material the magnetic product is cleaned of nonmagnetic mineral grains by wash water fed into said annular gap and uniformly distributed therein by the device 9 constructed in the form of a circular element.

A portion of the wash water and some liquid phase of the pulp getting together with the magnetic product into the bottom part of the separator housing 1 are drawn through the holes in the disks 7 and the clearances therebetween into the underpressure zone underneath the paddle agitator 4, whereby nonmagnetic mineral grains still contained in the magnetic product are entrained and further cleaning of the magnetic product is accomplished. Nonmagnetic mineral grains and concretions are carried by the upward rising water current into the top part of the separator housing 1 and are discharged by means of the nonmagnetic product discharging device 5, whereas the magnetic product is discharged from the bottom part of the separator housing 1 through the branch 6.

The system of the disks 7 spaced apart and rigidly installed one under the other directly underneath the pulp feeding device 3 in the bottom part of the separator housing 1 divides said housing into two parts, viz: the top part wherein the major separation process is carried out and the bottom part wherein the recovered magnetic product is thickened. The system of the disks 7 prevents the vertical pulp circulation, which is created by the paddle agitator 4 and is detrimental to the separation process, from spreading into the bottom part of the separator housing 1. Inasmuch as the diameters of the disks 7 increase from top to bottom and the diameter of the bottom disk 7 is larger than the diameter of the pulp feeding device 3, the feed can pass into the bottom part of the separator housing 1 only after separation of nonmagnetic mineral grains.

The provision of the bottom disk 7 with the wash water feeding device 9, which is located underneath the disk and coaxially therewith and is constructed in the form of a circular element with tangential branches for feeding wash water in a predetermined direction, there being a gap all the way around the circular element at the side thereof facing the bottom disk 7 and the separator housing 1, makes it possible to feed wash water in the appropriate direction without causing additional turbulent pulsations in the pulp flow. It also allows for distributing wash water in the annular gap between the system of the disks 7 and the separator housing 1 through which the magnetic product passes into the bottom part of the separator housing 1 where it is thickened, as well as for feeding water through the holes in the disks 7 and the clearances therebetween. Thus, wash water is distributed in the directions which ensure additional cleaning of the magnetic product.

With the constructional arrangement wherein the system of the disks 7 is located directly underneath the pulp feeding device 3, the disks 7 have center holes with appropriate diameters, and clearances are provided between the disks 7, flow of pulp into the separator housing 1 gives rise to formation of underpressure areas in the clearances between the disks 7 so that resultant suction causes a considerable flow of pulp, which contains grains of nonmagnetic minerals, from the bottom part of the separator housing 1 via the holes in the disks 7 and the clearances therebetween into the top part of the separator housing 1. Thus, in the bottom part of the separator housing 1 a flow is created in the direction which provides for additional cleaning of the magnetic product is said bottom part of the separator housing.

The constructional arrangement wherein the paddle agitator 4 is located inside the pulp feeding device in the bottom part thereof directly above the system of the disks 7 and coaxially therewith, and the direction of rotation of the paddles of the agitator 4 coincides with the direction of feed of wash water, prevents the possibility of the vertical pulp circulation created by the paddles of the agitator 4 spreading from the pulp feeding device 3 into the separator housing 1. Thus, provision is made for creating a tranquil upward helical flow of pulp in the separator housing 1 above the disks 7 since, with the abovementioned location of the paddle agitator 4, turbulent circulation caused by the rotation of the agitator paddles develops only inside the cylindrical part of the pulp feeding device 3. Considerable dynamic forces arising between the inside surface of the pulp feeding device 3 and the paddles of the agitator 4 do not disturb the appropriate hydrodynamic conditions of pulp flow in the separator housing 1 where the separation process is effected. Said dynamic forces make it possible to perform disintegration and partial surface cleaning of mineral grains, thereby adding to the selectivity of separation.

The use of the tangential branches 11 in the top part of the pulp feeding device 3 provides for creating centrifugal currents in the cylindrical part of the pulp feeding device 3 so that by virtue of centrifugal forces the pulp is rapidly rid of air contained therein. This air, if allowed to get from the pulp feeding device 3 into the separator housing 1, may upset the hydrodynamic conditions of pulp flow required for selective separation of grainy minerals.

By installing all the tangential branches 10 and 11 in such a manner that the direction of the flow of pulp and wash water issuing therefrom coincides with the direction of rotation of the paddles of the agitator 4 and, consequently, with the general direction of the rotary pulp flow, provision is made for decreasing the turbulent pulp circulation which is caused by mixing of currents and rotation of the agitator paddles and is detrimental to the separation process.

By locating the system of the disks 7, the pulp feeding device 3 and the paddle agitator 4 inside the separator housing 1 in the part thereof embraced by the circular electromagnetic system 2, provision is made for separating grains of magnetic minerals from grains of nonmagnetic minerals and their concretions by the action of the magnetic field created by the circular electromagnetic system 2.

On the whole, the employment and arrangement of said constructional elements in the separator provide for creating the hydrodynamic conditions of pulp flow required for highly selective wet separation of mineral grains by the agency of their magnetic properties, which results in increased operating efficiency of the electromagnetic separator.

The electromagnetic separator according to the present invention provides for producing iron concentrates wherein impurity content does not exceed 1.5 percent and is 2 to 5 times less than in the product of the separators known in the prior art.

In concentrating finely ground and slimy ores, the use of the electromagnetic separator makes it possible to reduce the number of concentration operations 1.5 to 2 times as compared with the drum separators known in the prior art.

Technological tests of the electromagnetic separator have been conducted in concentrating ferruginous quartzite and titanomagnetite from various deposits in the Soviet Union and also in treating magnetite-apatite-francolite ores from the deposits of Kovdor (USSR) and Sokli (Finland). The use of the electromagnetic separator for producing magnetite concentrate from magnetite-francolite ores makes it possible to halve the number of magnetic separation operations as compared with the best magnetic drum separators known in the art and provides for increasing iron content is concentrate from 64 percent to 68 percent and decrease content of phosphorus pentoxide from 2.4 percent to 0.3 percent. Cost reduction per ton of ore in a cycle of magnetic concentration is 15 percent in running cost and 20 percent in outlay.

It follows from the aforesaid data that due to novel design features the electromagnetic separator of the present invention provides increased efficiency of wet separation of grainy minerals by the agency of their magnetic properties.

Thus, the use of the present invention in the industry will permit improving the quality of magnetite concentrate and the recovery of iron therefrom, thereby increasing the efficiency of the processes of deep dressing of iron concentrate.

What is claimed is:

1. An electromagnetic separator comprising:

a cylindrical housing with a conical bottom, said housing having a top part and a bottom part;

a circular electromagnetic system installed on the outside of said housing and embracing a part thereof;

a cylindrical pulp feeding device installed inside said housing coaxially therewith, said device having a top part and a bottom part;

a non-magnetic product discharging device located in said top part of said housing;

a magnetic product discharge branch located in said bottom part of said housing;

a system of disks spaced apart and rigidly installed one under the other in said bottom part of said housing coaxially therewith, directly underneath said pulp feeding device, said system comprising the top, the second and all the subsequent disks, including the bottom one; center holes in said second and all the subsequent disks, including the bottom one, the diameters of said holes decreasing from said bottom disk to said second disk, said holes being smaller than the diameter of the next upper disk, the diameters of said disks increasing from said top disk to said bottom disk, the diameters of said top and bottom disks being respectively smaller and larger than the diameter of said pulp feeding device;

a wash water feeding device located underneath said bottom disk coaxially therewith and constructed in the form of a circular element including means for distributing the wash water between said system of disks and said separator housing;

directional feeding means designed for feeding wash water in a predetermined direction and installed tangentially on said circular element;

a paddle agitator of said cylindrical pulp feeding device, said paddle agitator being installed inside said pulp feeding device in said bottom part thereof directly over said system of disks, coaxially therewith, the paddles of said agitator being designed to rotate in the direction coinciding with the direction of wash water feed; and tangential means installed in said top part of said pulp feeding device for the purpose of feeding pulp in the direction coinciding with the direction of wash water feed and with that of rotation of said agitator paddles;

said system of disks, wash water feeding device and agitator located in said part of the housing embraced by said circular electromagnetic system for the purpose of creating the required magneto hydrodynamic conditions of pulp flow.

2. An electromagnetic separator as claimed in claim 1, wherein said means for distributing the wash water includes a gap formed between the outer side of said circular element and said bottom disk, said gap being formed all the way around said circular element and facing said bottom disk.

3. An electromagnetic separator as claimed in claim 2, wherein said tangential means includes a plurality of tangential branches installed in the top part of said pulp feeding device.

4. An electromagnetic separator as claimed in claim 3, wherein said directional feeding means includes a plurality of wash water branches.

5. An electromagnetic separator comprising:

a cylindrically-shaped housing including a conical bottom, a top part and a bottom part;

a substantially circular electromagnetic system operatively associated with said housing substantially coextensive therewith and embracing a part thereof;

a substantially cylindrically-shaped pulp feeding means within said housing and coaxial therewith, said feeding means including a top part and a bottom part;

means for discharging a non-magnetic product located in the top part of said housing;

a system of spaced disks rigidly installed one under the other in the bottom part of said housing coaxially therewith directly under said pulp feeding means, said system comprising a top disk, a second disk, and all subsequent disks including a bottom disk, the diameters of said disks increasing from said top disk to said bottom disk, and passage means for permitting the pulp to pass upward through said system of disks into the top part of said housing;

wash water feeding means located underneath said bottom disk coaxially therewith, said wash water feeding means including a substantially circular element, distribution means for distributing wash water from said circular element into the area between said system of disks and said cylindrical housing; and directional feeding means for feeding the wash water in a predetermined direction into said circular element;

pulp agitating means for rotating the pulp in said pulp feeding means in a direction coinciding with the direction of said wash water directional feeding means; and tangential means for feeding the pulp into said pulp feeding means in a tangential direction coinciding with the direction of said wash water feeding means and coinciding with the direction of rotation of said pulp agitating means;

said system of disks, wash water feeding means, and pulp agitating means being located in the part of said housing embraced by said electromagnetic system for creating the required magnetic and hydrodynamic conditions of pulp flow.

6. An electromagnetic separator as claimed in claim 5, wherein said distribution means includes a gap formed between the outer side of said circular element and said bottom disk, said gap being formed all the way around said circular element and facing said bottom disk.

7. An electromagnetic separator as claimed in claim 5, wherein said passage means includes center holes formed in said second and said subsequent disks including said bottom disk, the diameters of said holes decreasing from said bottom disk to said second disk, said holes being smaller than the diameter of the next upper disk.

8. An electromagnetic separator as claimed in claim 5, wherein said pulp agitating means includes a paddle agitator installed inside said bottom part of said pulp feeding device directly over said system of disks coaxially therewith, the paddles of said agitator being designed to rotate in a direction coinciding with the direction of said wash water feed.

* * * * *